US010757494B2

(12) United States Patent
Lee et al.

(10) Patent No.: US 10,757,494 B2
(45) Date of Patent: Aug. 25, 2020

(54) SYMMETRIC DUAL SUSPENSION SPEAKER STRUCTURE

(71) Applicant: Eastech (Huiyang) Co., Ltd., Huizhou, Guangdong (CN)

(72) Inventors: Kheng-Wee Lee, Singapore (SG); Zuojian Huang, Huizhou (CN)

(73) Assignee: EASTECH (HUIYANG) CO., LTD., Huizhou (CN)

( * ) Notice: Subject to any disclaimer, the term of this patent is extended or adjusted under 35 U.S.C. 154(b) by 0 days.

(21) Appl. No.: 16/223,119

(22) Filed: Dec. 18, 2018

(65) Prior Publication Data

US 2020/0196039 A1 Jun. 18, 2020

(51) Int. Cl.

| | |
|---|---|
| ***H04R 9/04*** | (2006.01) |
| ***H04R 1/02*** | (2006.01) |
| ***H04R 1/28*** | (2006.01) |
| ***H04R 31/00*** | (2006.01) |
| ***H04R 9/02*** | (2006.01) |

(52) U.S. Cl.

CPC ..... *H04R 1/026* (2013.01); *H04R 1/2876* (2013.01); *H04R 9/025* (2013.01); *H04R 9/043* (2013.01); *H04R 31/006* (2013.01)

(58) Field of Classification Search

CPC ... H04R 7/16; H04R 7/18; H04R 7/24; H04R 7/26; H04R 9/025; H04R 9/043; H04R 2209/024; H04R 2400/11

See application file for complete search history.

(56) References Cited

U.S. PATENT DOCUMENTS

| | | | | |
|---|---|---|---|---|
| 8,290,199 | B2 * | 10/2012 | Pircaro | H04R 9/06 381/398 |
| 8,774,448 | B2 * | 7/2014 | Li | H04R 9/025 381/398 |
| 9,712,921 | B2 * | 7/2017 | Salvatti | H04R 9/043 |
| 9,918,166 | B2 * | 3/2018 | Wu | H04R 9/043 |
| 10,277,986 | B2 * | 4/2019 | Li | H04R 9/043 |
| 2003/0121718 | A1 * | 7/2003 | Stead | H04R 7/00 181/172 |
| 2006/0062418 | A1 * | 3/2006 | Hashiba | H04R 1/06 381/386 |

(Continued)

FOREIGN PATENT DOCUMENTS

| | | | | |
|---|---|---|---|---|
| WO | WO-2013007112 | A1 * | 1/2013 | H04R 7/18 |

*Primary Examiner* — Fan S Tsang
*Assistant Examiner* — Ryan Robinson
(74) *Attorney, Agent, or Firm* — Chun-Ming Shih; Lanway IPR Services

(57) ABSTRACT

A symmetric dual suspension speaker structure is herein disclosed, comprising a basin frame, a U-shaped iron, a magnet permeability ferrite ring, a corrugated rim, a diaphragm, a sound coil, a damper clamped between the magnet permeability ferrite ring and the U-shaped iron, as well as a magnet, wherein the peripheral edge around the upper surface of the diaphragm can be stretched in the vertical direction to form a barrel component, and the corrugated rim is used to bond and fix the top end of the barrel component while the damper is used to bond and fix the bottom end of the barrel component, such that the sound coil can bring the barrel component of the diaphragm to vertically vibrate thus improving the instability existing in the bonding of the conventional diaphragm and the coil framework.

4 Claims, 8 Drawing Sheets

(56) References Cited

U.S. PATENT DOCUMENTS

| | | | | |
|---|---|---|---|---|
| 2008/0166010 | A1* | 7/2008 | Stiles | H04R 7/24 381/423 |
| 2011/0274309 | A1* | 11/2011 | Doh | H04R 9/047 381/398 |
| 2014/0056447 | A1* | 2/2014 | Li | H04R 1/00 381/162 |
| 2014/0119591 | A1* | 5/2014 | Meng | H04R 9/02 381/386 |
| 2015/0326960 | A1* | 11/2015 | Niedermann | H04R 5/00 381/300 |
| 2019/0104369 | A1* | 4/2019 | Kim | H04R 9/043 |

* cited by examiner

SYMMETRIC DUAL SUSPENSION SPEAKER STRUCTURE

BACKGROUND OF THE INVENTION

1. Field of the Invention

The present invention generally relates to a symmetric dual suspension speaker structure; in particular, it relates to a speaker structure capable of improving the vertical centering ability for coil vibrations, increasing sound coil strokes, as well as lessening sound coil frictions and distortions.

2. Description of Related Art

A conventional electric speaker 1 is shown in FIG. 1, mainly comprising a magnetic circuit system, a vibration system, and a suspension system for supporting the vibration system. It can be seen that the magnetic circuit system includes a washer 11, a magnet 12 and a U-shaped iron 13, the vibration system has a sound coil 14, a framework 15 and a diaphragm 16, and the suspension system essentially includes a corrugated rim 17 located at the outer periphery of the speaker diaphragm 16 and a damper 18 for fixing the sound coil 14.

Herein the sound coil 14 moves in the magnetic gap created by the magnetic circuit system. The operational principle of the above-mentioned speaker can be roughly explained as below: transferring alternating current implicitly comprising audio signals to the sound coil 14 in order to cause the sound coil 14 to vibrate vertically in the magnetic gap, and the vibrations of the sound coil 14 bring the diaphragm 16 to move by means of the framework 15 such that the diaphragm 16 vibrates and compresses the air to reproduce the sound.

However, in practice, certain drawbacks do exist in such speakers of conventional structures. For example, the suspension system is located at the top end of the coil, so that, when the sound coil vibrates up and down in the magnetic gap, the lower end of the sound coil may easily sway and chafes the inner and outer walls of the magnetic gap thus resulting in unwanted noises.

Hence, in the trend of modern audio development, the increasing requirements for thinner profiles, lighter weights and withstanding more power or the like make the above-mentioned speakers of conventional structure designs fail to completely satisfy the demands.

Therefore, it would be an optimal solution if it is possible to provide a type of symmetric dual suspension speaker structure which allows to let the diaphragm vertically extend downwards to form a barrel component, and bond and fix the upper and lower ends of the barrel component by means of the corrugated rim and the damper, thus enabling the sound coil to bring the barrel component of the diaphragm to vibrate vertically so as to reduce the instability existing in the bonding between the conventional diaphragm and the coil framework.

SUMMARY OF THE INVENTION

A symmetric dual suspension speaker structure according to the present invention is disclosed, comprising: a basin frame, configured with an opening; a U-shaped iron, an element having a basin-wise appearance; a magnetic permeability ferrite ring, installed between the basin frame and the U-shaped iron, with the top end thereof being in contact with the bottom end of the basin frame and the center thereof having a ring opening;

a corrugated rim, including a corrugated rim outer ring and a corrugated rim inner ring, in which the corrugated rim outer ring is installed at the opening of the base frame; a diaphragm, in which the diaphragm upper surface is connected to the corrugated rim inner ring, and the peripheral edge of the diaphragm upper surface can be stretched in the vertical direction to form a barrel component; a sound coil, winding around the outer surface of the barrel component;

a damper, including a damper outer ring and a damper inner ring, in which the damper inner ring is used to connected with the barrel component of the diaphragm through the opening of the basin frame and the outer bottom edge of the ring opening in the magnetic permeability ferrite ring, while the damper outer ring is fixedly clamped between the top end of the U-shaped iron and the bottom end of the magnetic permeability ferrite ring; and a magnet, set up inside the U-shaped iron, and the top end thereof further installed with a washer thereby clamping in package the magnet in cooperation with the U-shaped iron.

More specifically, the diaphragm and the barrel component are integrally designed.

More specifically, the corrugated rim is used to bond and fix the top end of the barrel component and the damper is used to bond and fix the bottom end of the barrel component, such that the sound coil can bring the barrel component of the diaphragm to vertically vibrate.

More specifically, the outer surface of the barrel component includes multiple holes.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
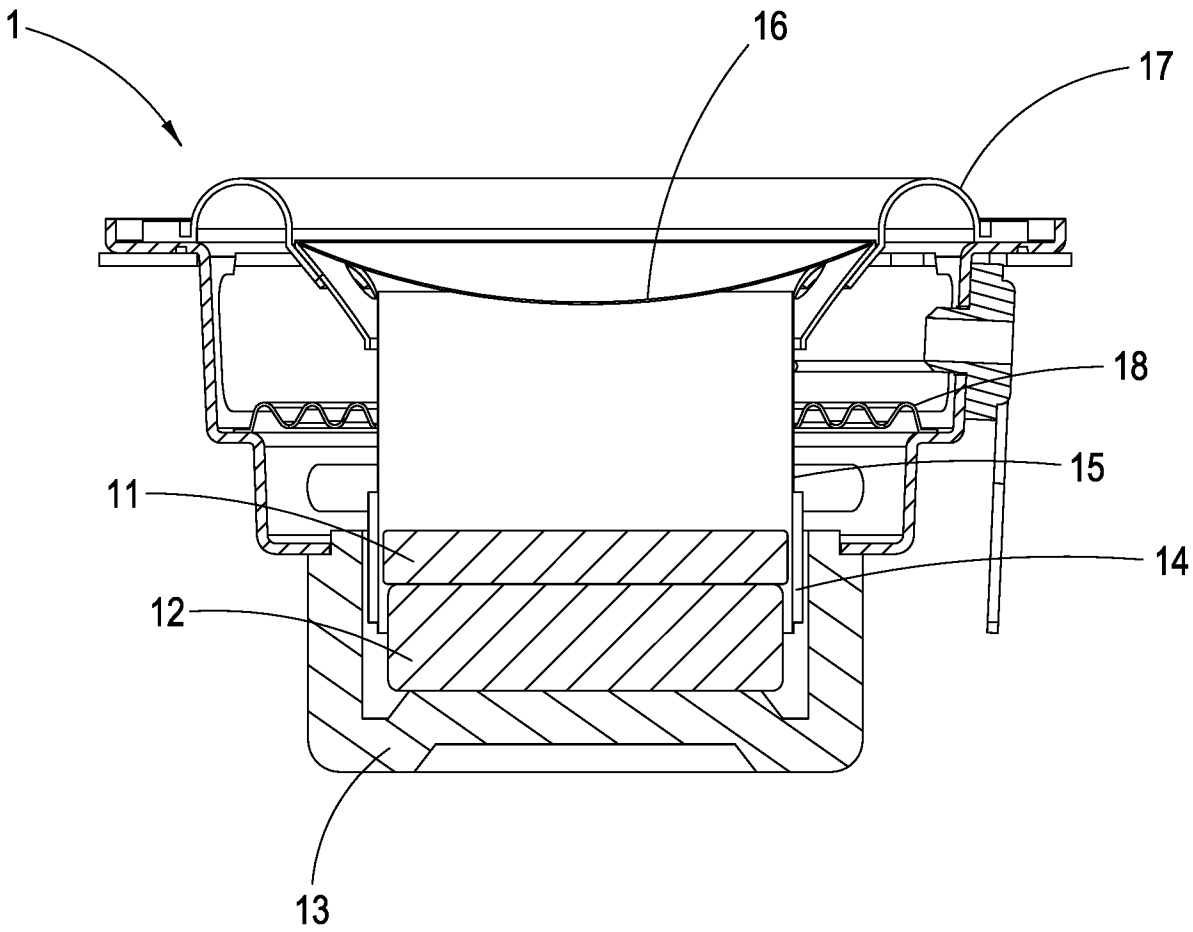
FIG. 1 PRIOR ART
FIG. 1 shows a cross-sectioned structural view of a conventional speaker structure.
Figure 2:
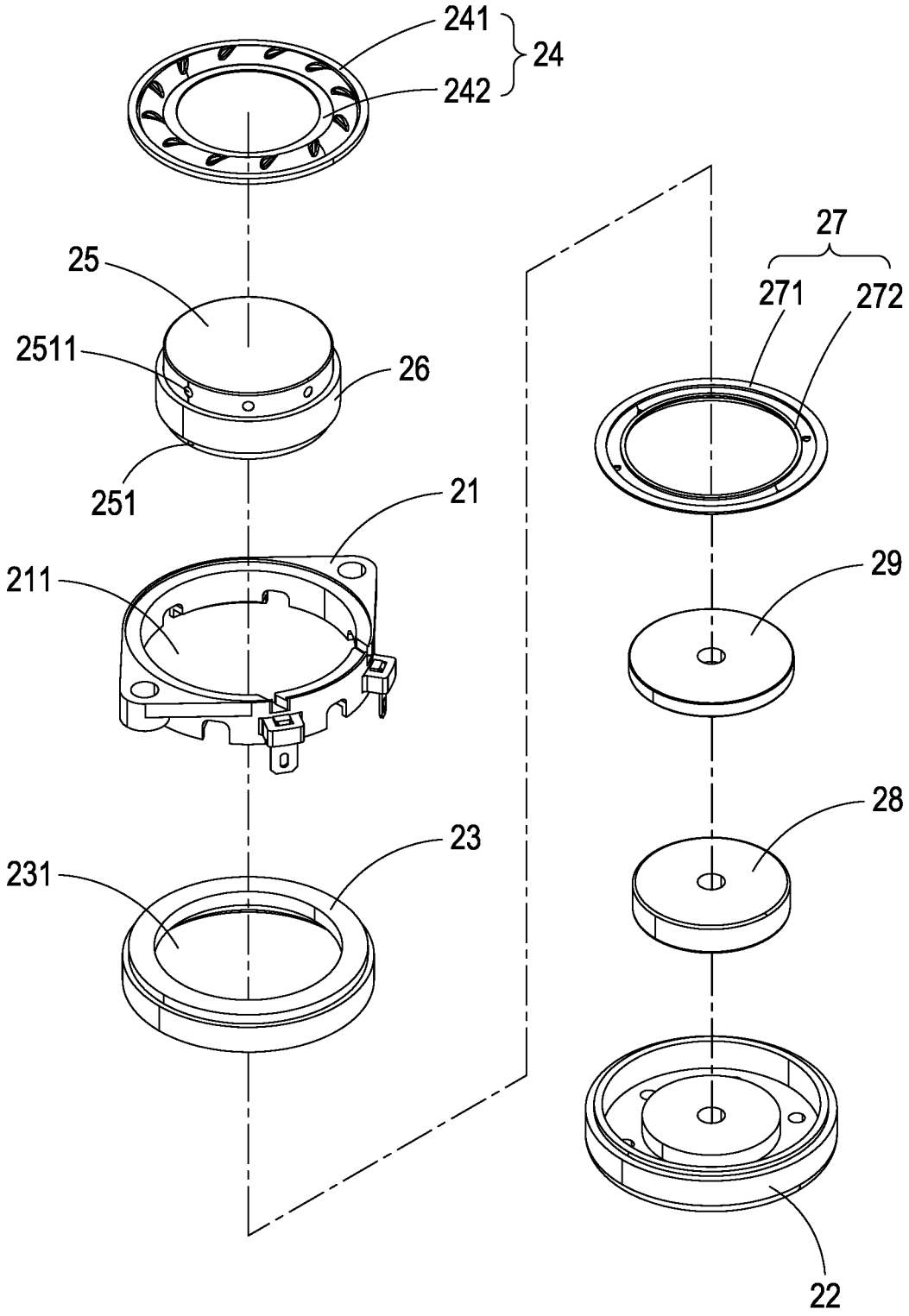
FIG. 2 shows a disassembled structural view of the symmetric dual suspension speaker structure according to the present invention.
Figure 3:
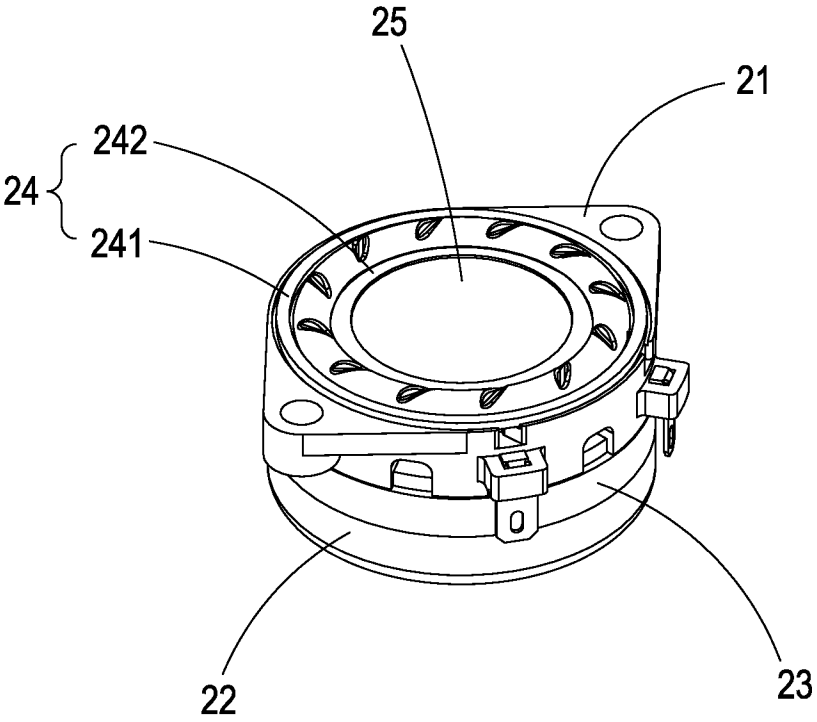
FIG. 3 shows an assembled structural view of the symmetric dual suspension speaker structure according to the present invention.
Figure 4:
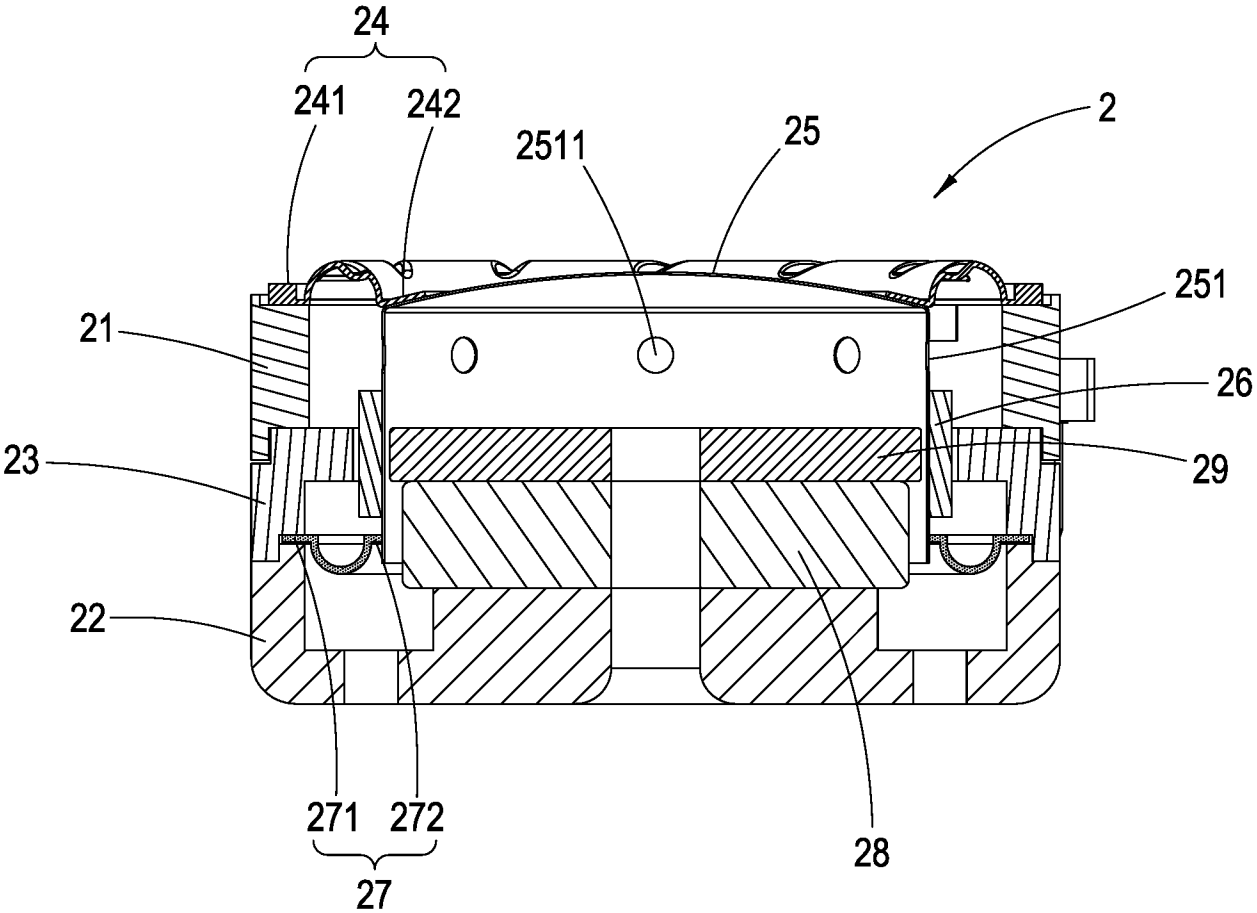
FIG. 4 shows a cross-sectioned structural view of the symmetric dual suspension speaker structure according to the present invention.

Refer first to FIGS. 2-4, wherein a disassembled structural view, an assembled structural view and a cross-sectioned structural view of the symmetric dual suspension speaker structure according to the present invention are respectively shown. As shown, it can be appreciated that the symmetric dual suspension speaker structure 2 comprises a basin frame 21, a U-shaped iron 22, a magnet permeability ferrite ring 23, a corrugated rim 24, a diaphragm 25, a sound coil 26, a damper 27 and a magnet 28.

Herein the basin frame 21 is configured with an opening 211, the U-shaped iron 22 is an element having a basin-wise appearance, and the magnetic permeability ferrite ring 23 is installed between the basin frame 21 and the U-shaped iron 22, in which the top end of the magnetic permeability ferrite ring 23 is in contact with the bottom end of the basin frame 21, and also the center of the magnetic permeability ferrite ring 23 has a ring opening 231.

In addition, the corrugated rim 24 includes a corrugated rim outer ring 241 and a corrugated rim inner ring 242, in which the corrugated rim outer ring 241 is installed at the opening 211 of the base frame 21, the upper surface of the diaphragm 25 is connected to the corrugated rim inner ring 241, and the peripheral edge around the upper surface of diaphragm 25 can be stretched in the vertical direction to form a barrel component 251 (herein the diaphragm 25 and the barrel component 251 are integrally designed); also, the sound coil 26 is winding installed around the outer surface of the barrel component.

Further, the damper 27 includes a damper outer ring 271 and a damper inner ring 272, in which, after the barrel component 251 of the diaphragm 25 penetrates through the opening 211 of the basin frame 21 and the ring opening 231 of the magnetic permeability ferrite ring 23, the outer bottom edge of the barrel component 251 can be connected with the damper inner ring 272, while the damper outer ring 271 is fixedly clamped between the top end of the U-shaped iron 22 and the bottom end of the magnetic permeability ferrite ring 23.

Moreover, the magnet 28 is set up inside the U-shaped iron 22, and the top end of the magnet 28 is further installed with a washer 29 thereby clamping in package the magnet 28 in cooperation with the U-shaped iron 22.

Figure 5:
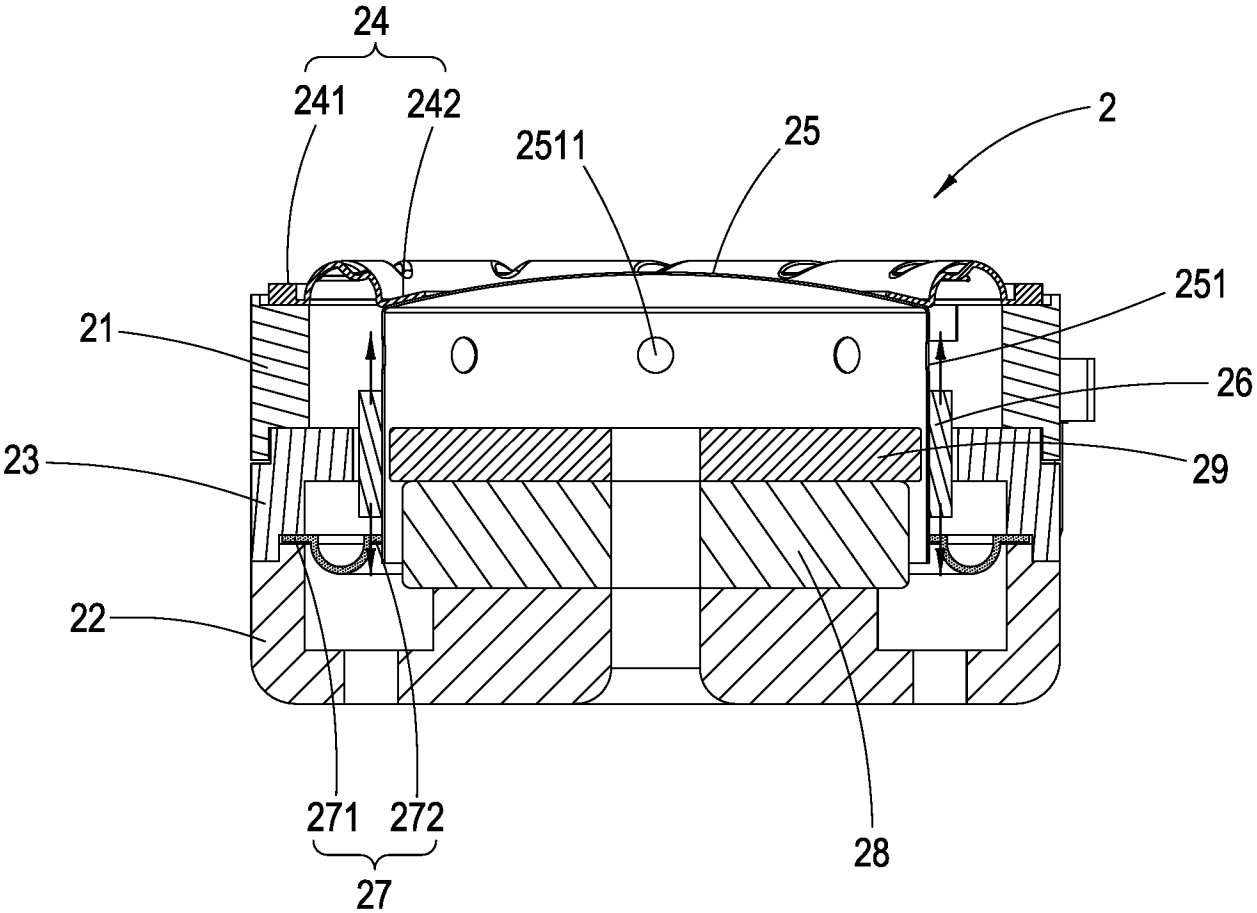
FIG. 5 shows an operational implementation view of the symmetric dual suspension speaker structure according to the present invention.

Seeing that the corrugated rim 24 is used to bond and fix the top end of the barrel component 251 and the damper 27 is used to bond and fix the bottom end of the barrel component 251, once the sound coil 26 placed within the magnetic gap is provided with electric power, as shown in FIG. 5, it can vertically vibrate under the magnetic field effect, thereby driving the diaphragm 25 to generate and spread sounds; accordingly, it can be appreciated that the corrugated rim 24 and the damper 27 may act as a suspension system to support and balance the vibrations thereof.

Also, the outer surface of the barrel component 251 includes multiple holes 2511 thereby providing an enhanced heat dissipation feature.

Figure 6:
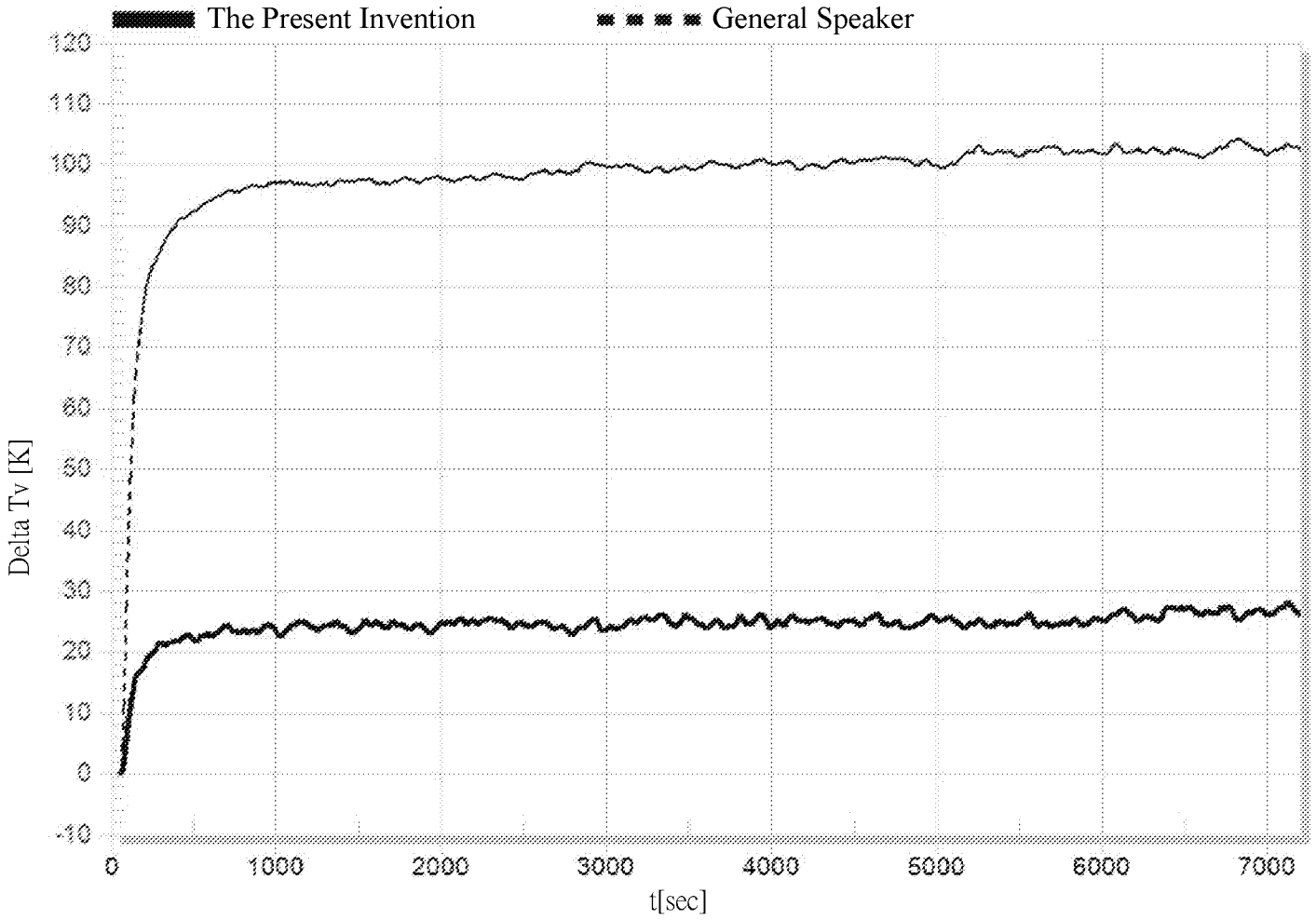
FIG. 6 shows a temperature test diagram for the sound coil of the symmetric dual suspension speaker structure according to the present invention.

Next, as shown in FIG. 6, with respect to a 10-Watt power test, the present invention is compared with the general speaker in terms of sound coil temperature, and it can be clearly seen that, after the 3-hour test, the sound coil temperature of the speaker according to the present invention rises up 29 degrees, while the sound coil temperature in the general speaker greatly ascends 104 degrees, indicating a comparatively smaller temperature increase in the sound coil of the speaker according to the present invention (the above-mentioned temperature increase represents a variation value in comparison with the static state; i.e., ambient temperature); therefore, the speaker can withstand higher power and its sound coil may not burn out easily.

Figure 7:
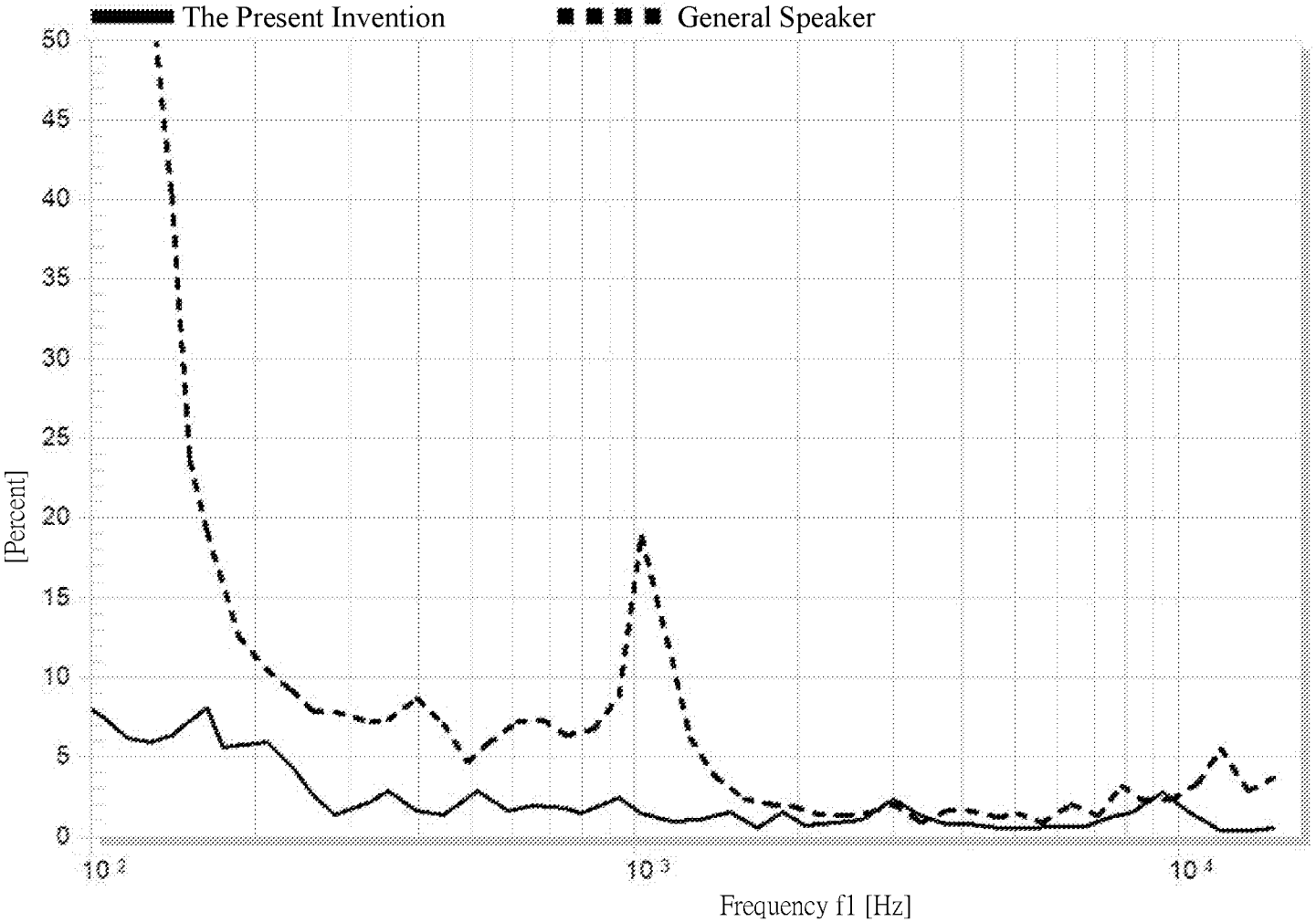
FIG. 7 shows a relative total harmonic distortion test diagram of the symmetric dual suspension speaker structure according to the present invention.

Subsequently, as shown in FIG. 7, it illustrates a Relative Total Harmonic Distortion test on the present invention and the general speaker, and clearly demonstrates that the distortion rate of the speaker according to the present invention is significantly reduced at lower frequencies.

Figure 8:
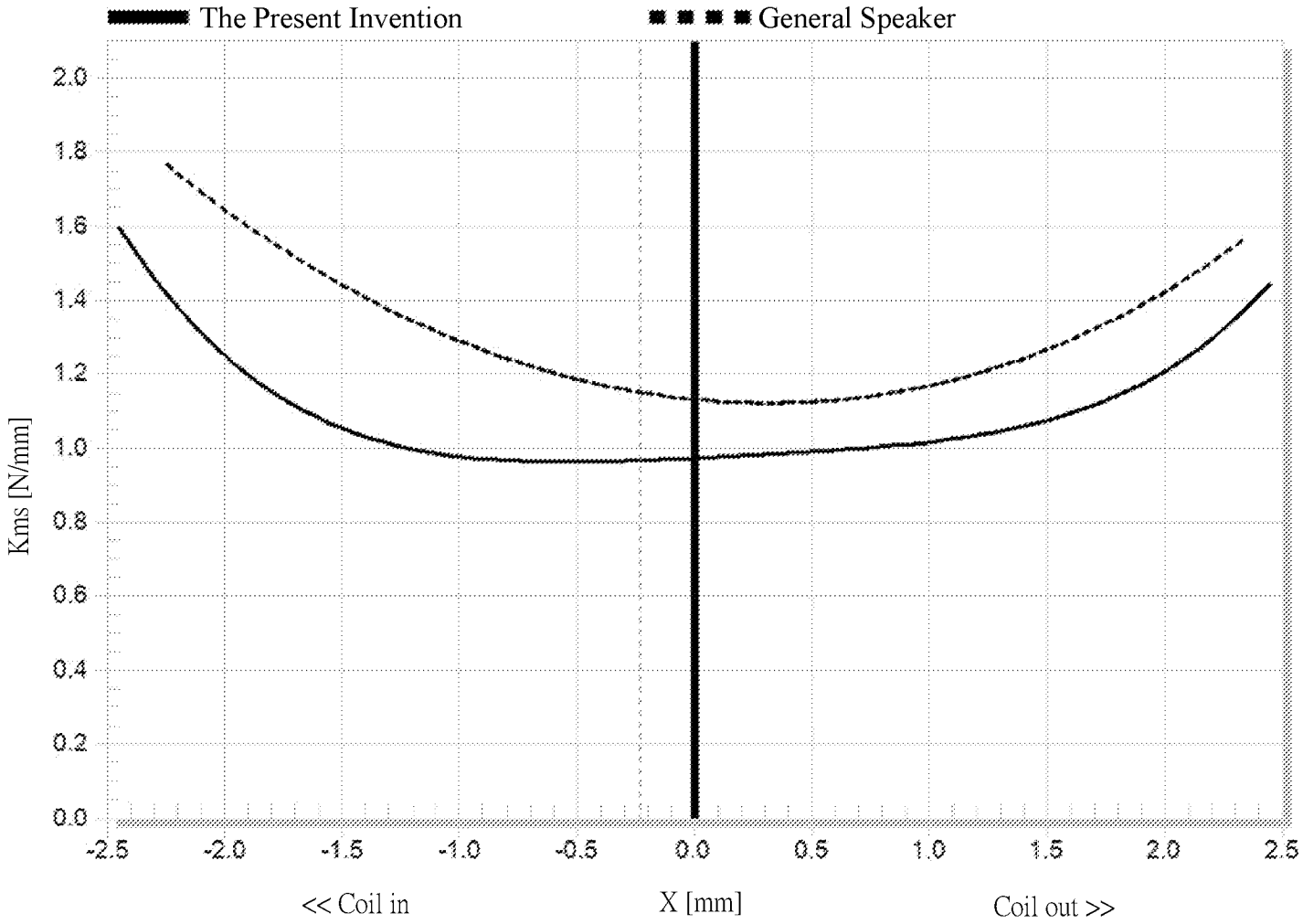
FIG. 8 shows a symmetry test diagram of the symmetric dual suspension speaker structure according to the present invention.

Furthermore, as shown in FIG. 8, a symmetry test (i.e., Stiffness of Suspension Kms(X)) has been performed on the present invention and the general speaker, in which the Kms(X) mainly describes the non-linear relationship between the Kms (rigidity/symmetry/stiffness) of the speaker's suspension system and the displacement of the sound coil thereof (herein "coil in" represents the length that the sound coil moves towards the inside of the magnetic gap, and "coil out" the length that the sound coil moves towards the outside of the magnetic gap), and the unit of Kms is [N/mm] From the Figure, It can be observed that the Kms of the present invention is better than the general speaker, so, upon signals of larger power, the rigidity/symmetry may significantly ascent as the displacement increases, thus generating bigger restoration force, so the suspension system (i.e., the corrugated rim and the damper) in the present invention may be stretched, with better Kms performance facilitating lower distortion rate.

In comparison with other conventional technologies, the symmetric dual suspension speaker structure according to the present invention provides the following advantages:

(1) The peripheral edge around the upper surface of the diaphragm in the present invention may be stretched in the vertical direction to form a barrel component, and the corrugated rim and the damper respectively bond and fix the upper and lower end of the barrel component, thereby allowing the sound coil to bring the barrel component of the diaphragm to vibrate vertically so as to reduce the instability existing in the bonding between the conventional diaphragm and the coil framework.

(2) The symmetric dual suspension speaker structure according to the present invention can reduce the height and size of the speaker and provide many advantages, such as improving the vertical centering ability of the sound coil vibrations, extending the voice coil strokes, lowering voice coil frictions and distortions, simplifying the structure for convenient implementations, etc.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A symmetric dual suspension speaker structure, comprising:

a basin frame, configured with an opening;

a U-shaped iron, wherein the U-shaped iron is an element having a basin-wise appearance;

a magnetic permeability ferrite ring, installed between the basin frame and the U-shaped iron, with the top end thereof being in contact with the bottom end of the basin frame and the center thereof having a ring opening, wherein a cross section of the ring is U-shaped;

a corrugated rim, including a corrugated rim outer ring and a corrugated rim inner ring, in which the corrugated rim outer ring is installed at the opening of the basin frame;

a diaphragm, in which the upper surface of the diaphragm is connected to the corrugated rim inner ring, and the peripheral edge around the upper surface of the diaphragm can be stretched in the vertical direction to form a barrel component;

a sound coil, winding around the outer surface of the barrel component;

a damper, including a damper outer ring and a damper inner ring, in which the damper inner ring is used to be connected with the outer bottom edge around the barrel component of the diaphragm through the opening of the basin frame and the ring opening in the magnetic permeability ferrite ring, while the damper outer ring is fixedly clamped between the top end of the U-shaped iron and the bottom end of the magnetic permeability ferrite ring; and a magnet, set up inside the U-shaped iron, and the top end thereof further installed with a washer thereby clamping in package the magnet in cooperation with the U-shaped iron;

wherein an edge of the basin frame, an edge of the U-shaped iron, and an edge of the magnetic permeability ferrite ring are configured with mutual snapping structures such that the basin frame, the U-shaped iron and the magnetic permeability ferrite ring are assembled in stack along a vertical direction, while outer peripheries of the U-shaped iron and the magnetic permeability ferrite ring are in direct contact, and the damper is fixedly clamped between inner peripheries of the U-shaped iron and the magnetic permeability ferrite ring.

2. The symmetric dual suspension speaker structure according to claim 1, wherein the diaphragm and the barrel component are integrally designed.

3. The symmetric dual suspension speaker structure according to claim 1, wherein the corrugated rim is used to bond and fix the top end of the barrel component and the damper is used to bond and fix the bottom end of the barrel component, such that the sound coil can bring the barrel component of the diaphragm to vertically vibrate.

4. The symmetric dual suspension speaker structure according to claim 1, wherein the outer surface of the barrel component includes multiple holes.

* * * * *